US005760679A

United States Patent [19]

Cotena

[11] Patent Number: 5,760,679

[45] Date of Patent: Jun. 2, 1998

[54] ACOUSTIC WARNING DEVICE, PARTICULARLY FOR MOTOR VEHICLES

[75] Inventor: Roberto Cotena, Vicenza, Italy

[73] Assignee: Fabrica Italiana Accumulatori Motocarri Montecchio—F.I.A.M.M. SPA, Vicenza, Italy

[21] Appl. No.: 793,008

[22] PCT Filed: Feb. 5, 1997

[86] PCT No.: PCT/EP95/03074

§ 371 Date: Apr. 7, 1997

§ 102(e) Date: Apr. 7, 1997

[87] PCT Pub. No.: WO96/04644

PCT Pub. Date: Feb. 15, 1996

[30] Foreign Application Priority Data

Aug. 5, 1994 [IT] Italy ..... TO94A0651

[51] Int. Cl.[6] ..... G08B 3/00

[52] U.S. Cl. ..... 340/384.1; 340/388.1; 340/388; 340/384.1

[58] Field of Search ..... 340/388.1, 388.7, 340/384.1, 384.7, 404, 391.1, 393.1, 396.1, 397.1; 116/137 R, 142 R; 181/157, 159, 175, 152, 144

[56] References Cited

U.S. PATENT DOCUMENTS

| | | | |
|---|---|---|---|
| 1,351,729 | 9/1920 | Ames | 340/384.1 |
| 1,789,947 | 1/1931 | Scofield et al. | 340/388 |
| 3,179,932 | 4/1965 | Gregoroff et al. | 340/388 |
| 4,241,334 | 12/1980 | Shintaku | 340/388 |
| 4,540,975 | 9/1985 | Kobayashi | 340/388 |
| 5,420,563 | 5/1995 | Frigo | 340/388.1 |

FOREIGN PATENT DOCUMENTS

| | | |
|---|---|---|
| 1091912 | 10/1960 | Germany . |
| 1201219 | 9/1965 | Germany . |
| WO9301588 | 1/1993 | WIPO . |

*Primary Examiner*—Jeffery Hofsass
*Assistant Examiner*—Toan Pham
*Attorney, Agent, or Firm*—Sughrue, Mion, Zinn, Macpeak & Seas, PLLC

[57] ABSTRACT

The acoustic warning device comprises a casing (1) in which at least one resiliently deformable diaphragm (10, 11) is mounted. In the casing (1) there is also mounted, in a fixed position, at least one excitation winding (19, 20). A movable ferromagnetic member (8, 9), subjected in use to the magnetic field generated by the winding (19, 20) is connected to the diaphragm (10, 11). The movable ferromagnetic member (8, 9) includes a substantially bell-shaped axial end portion (8*a*, 9*a*) disposed around the winding (19, 20).

13 Claims, 4 Drawing Sheets

ACOUSTIC WARNING DEVICE, PARTICULARLY FOR MOTOR VEHICLES

The present invention relates to acoustic warning devices, particularly for motor vehicles, of the kind defined in the introduction of claim 1.

An acoustic warning device of this kind is disclosed in WO093/01588. In this prior acoustic warning device, the circuit breaker is disposed in a closed chamber defined between a diaphragm and the housing.

U.S. Pat. No. 4,540,975 discloses an electromagnetic horn including a diaphragm coupled to the movable core of an electromagnet and a circuit breaker for interrupting the current supply to the winding of the electromagnet. The circuit breaker is also in this case disposed in a closed region comprised between the diaphragm and the horn housing.

The invention aims at providing an improved warning device of the above-specified kind.

This object is achieved according to the invention by an acoustic warning device having the features defined in claim 1.

Figure 1:
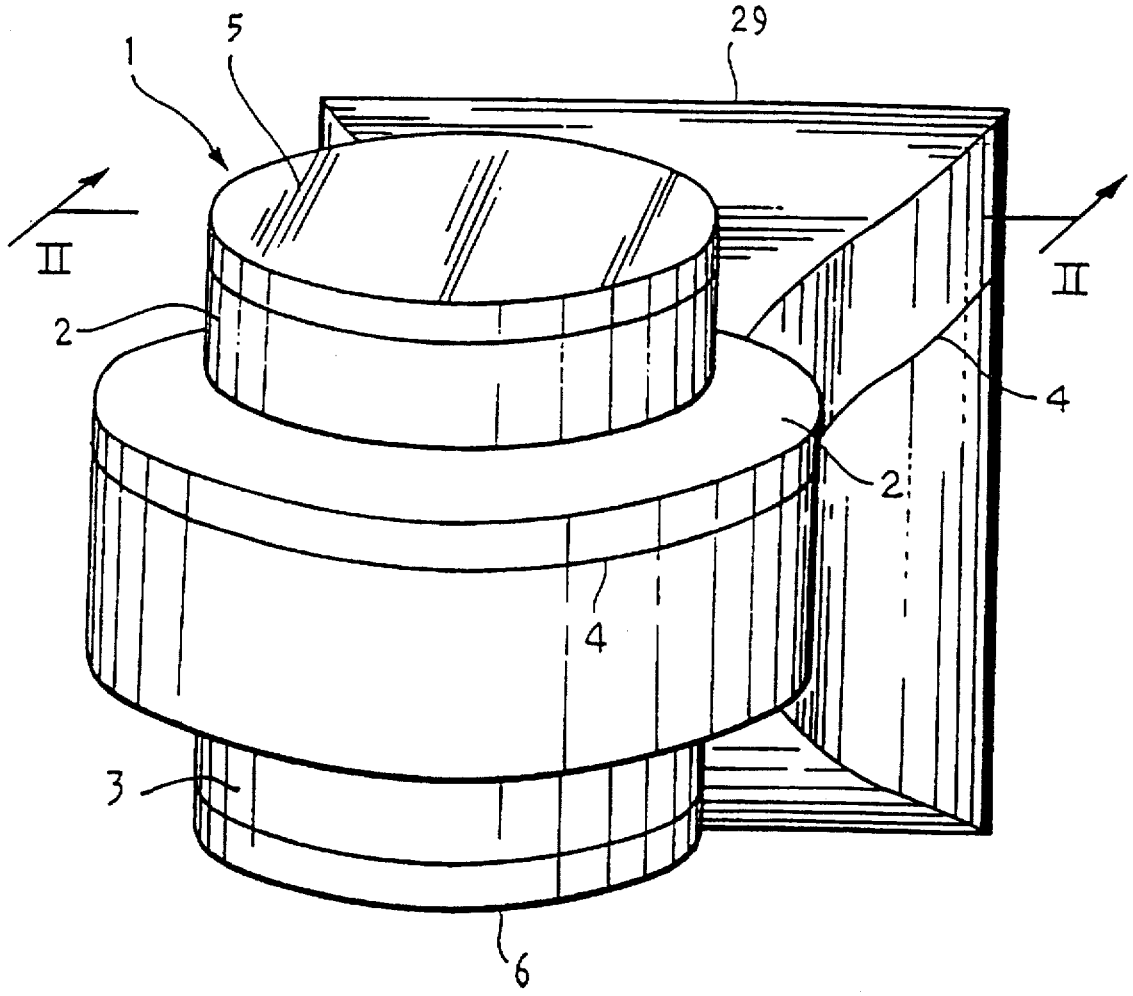
Figure 2:
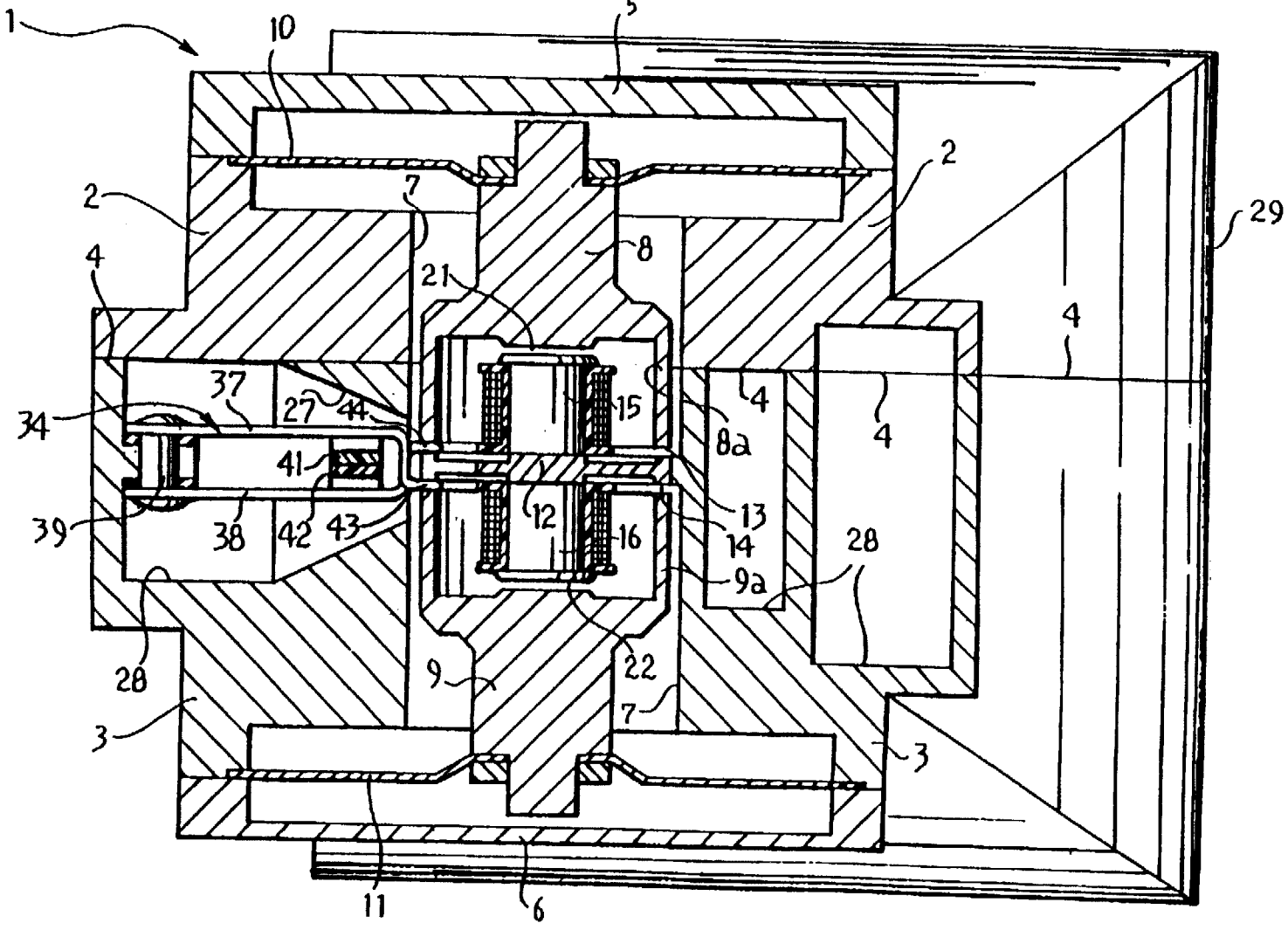
Figure 3:
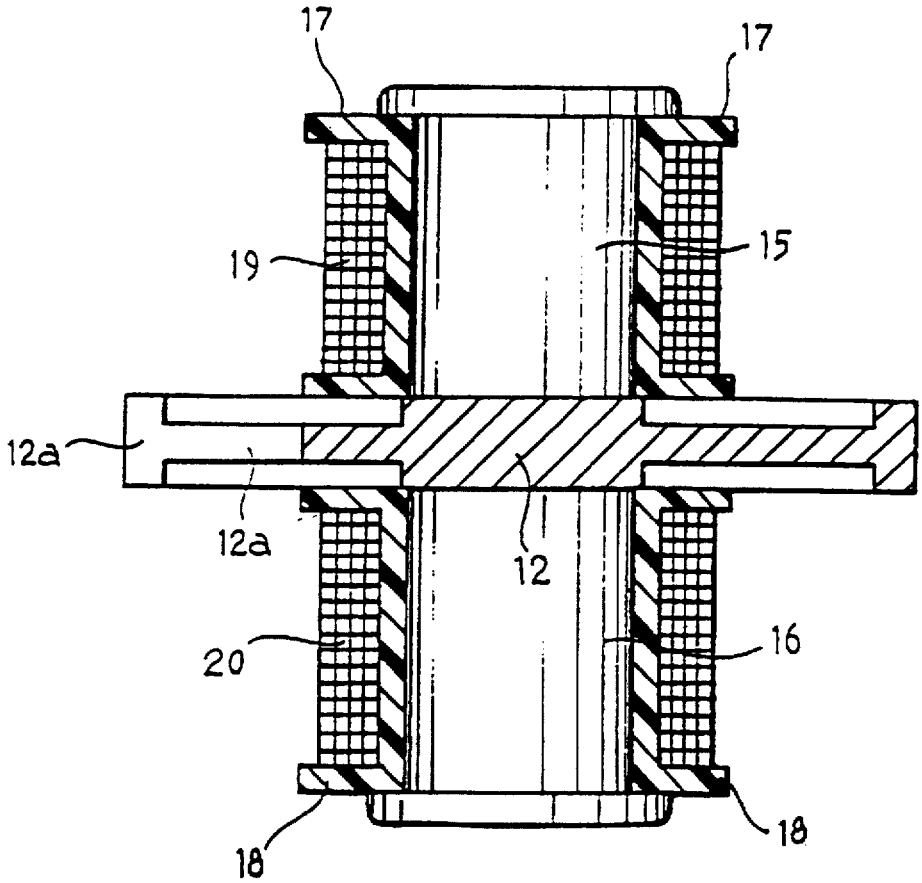
Figure 4:
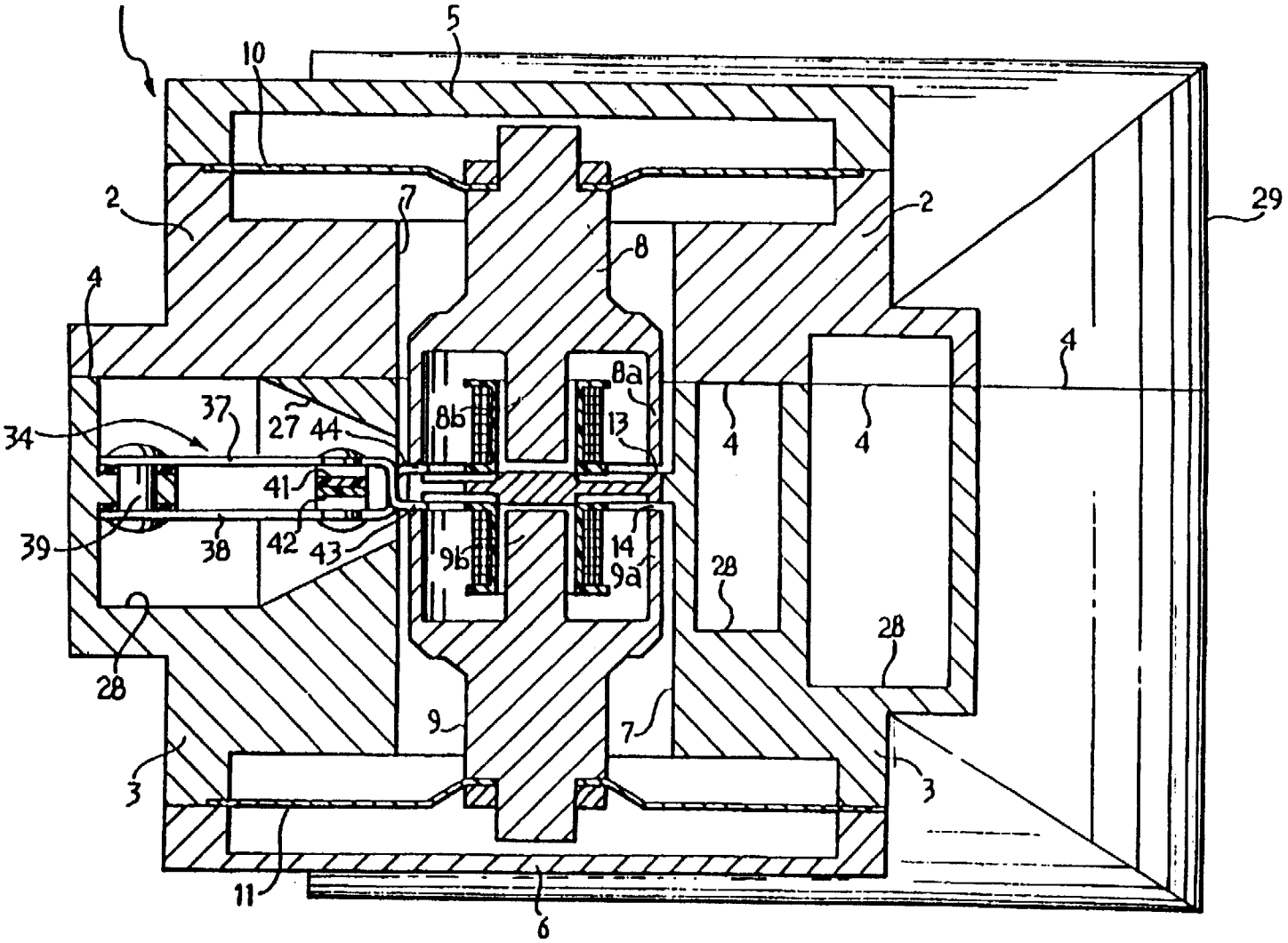

Further characteristics and advantages of the invention will become clear from the following detailed description given with reference to the appended drawings, provided purely by way of non-limiting example, in which:

FIG. 1 is a perspective view of an acoustic warning device according to the invention, FIG. 2 is a sectional view according to line II—II of FIG. 1, FIG. 3 is a partially sectioned, side elevation view, showing in an enlarged scale part of the acoustic warning device represented in FIG. 2, and FIG. 4 is a sectioned view similar to that represented in FIG. 2, showing a variant or second embodiment of an acoustic warning device according to the invention.

Referring to the drawings, and specifically to FIGS. 1 and 2, an acoustic warning signal for motor vehicles according to the invention comprises a support casing, generally indicated 1. The casing 1 is made for example of a plastic material.

In the embodiment shown by way of example, the casing 1 essentially comprises an upper portion 2 and a lower portion or body 3, which are bonded with each other, for example by means of a hot-plate device, in a plane 4 (FIG. 2).

The upper portion 2 of the casing 1 is closed by a cover 5 whereas the lower portion 3 is closed at the bottom by a cover 6. Also said cover or closure members 5 and 6 are conveniently made of a plastic material and can be bonded by ultrasonic welding (or other per se known methods) to the respective portions 2 and 3 of the casing 1.

As can be seen in FIG. 2, in the axial central portion of the casing 1 there is defined an essentially cylindrical passage 7 in which there are mounted two movable members 8 and 9 of ferromagnetic material, axially facing and aligned with each other.

The opposite ends of said members 8, 9 are connected to the central portions of two resilient membranes or diaphragms 10 and 11, made for example of a metal material, whose respective peripheral portions are clamped in the opposite end portions of the casing 1.

The axial terminal portions of members 8 and 9, facing each other and indicated 8*a* and 9*a* respectively, are shaped substantially in the form of bells.

In FIG. 2 at 12 there is indicated a stationary ferromagnetic member, substantially shaped as a disk, which is transversely fixed in the passage 7 of the casing 1 between the bell-shaped portions 8*a* and 9*a* of the movable members 8 and 9.

The periphery of said stationary ferromagnetic member 12 is separated from the end edaes of said movable elements 8, 9 by respective air gaps 13 and 14.

As can be more clearly seen in FIG. 3, two fixed cores 15, 16, made of ferromacnetic material, are connected to the central portions of the opposite faces of the stationary ferromagnetic member 12. Said fixed cores 15, 16 can be formed as separate elements, or integral with the disk-shaped member 12.

Around the fixed cores 15 and 16 there are provided respective spools 17 and 18 of an electrically insulating material, which are for example overmolded onto said cores 15 and 16. Said spools 17, 18 carry respective excitation windings, indicated 19 and 20.

The opposite ends of the fixed cores 15 and 16 are separated from the associated movable members 8 and 9 by air gaps 21 and 22 respectively (FIG. 2).

In operation, when the windings 19 and 20 are supplied with an excitation current, they generate magnetic fluxes which circulate in the disk-shaped ferromagnetic member 12, in the associated fixed cores 15 and 16 and in the bell portions 8*a*, 9*a* of the movable members 8 and 9. Under the effect of said magnetic fluxes the movable members 8 and 9 are attracted towards the disk-shaped ferromagnetic element 12 thus causing a resilient deformation of the diaphragms 10 and 11 respectively associated thereto.

In the casing 1, between the diaphragm 10 and 11 there is defined a variable-volume chamber, which through an essentially radial passage 27 is in communication with an acoustic outpzut conduit 28 defined in the casing 1.

Said acoustic conduit develops substantially like a spiral around the central passage 7 and terminates forming a flared output radiation section 29, shaped as a horn.

In operation, when the excitation windings 19 and 20 are supplied with a current, the movable ferromagnetic members 8 and 9 move one towards the other under the effect of the generated magnetic field, thus causing a resilien deformation of the diaphragms 10 and 1 and a reduction of the volume of the above-defined variable-volume chamber.

A breaker device, generally indicated 3 in FIG. 2, is mounted in the passage 27 which puts the variable-volume chamber into communicatIon with the output acoustic conduit 28.

In the illustrated embodiment said breaker device 34 comprises two shaped metal blades 37 and 38 having an end which is fixed in 39 to the casing 1. The opposite end portions of the blades 37 and 38 carry, in a mutually facing relationship, respective contact members 41 and 42. Beyond said contact members, the terminal portions of said ends of the blades 37 and 38 have respective appendixes, bent downwardly and upwardly, respectively, indicated 43 and 44. Said bent appendixes 43, 44 extend into the central cylindrical passage 7 of the casing 1 of the warning device, specifically between the end edges of the bellshaped portions 8*a*, 9*a* of the movable members 8, 9.

The terminal bent appendixes 43 and 44 of the blades 37 and 38 are staggered in a direction which is orthogonal to the plane of FIG. 2 and at rest are disposed adjacent or in contact with the end edges of the bell-shaped portions 9*a* and 8*a* of the movable members 9 and 8.

The disk-shaped ferromagnetic member 12 is conveniently provided with a radial slot, indicated 12*a* in FIG. 3, in correspondence with the ends of the bent appendixes 43, 44 of the blades 37, 38 of the breaker 34.

At rest, namely in the non-energized condition of windings 19 and 20, the contacts 41 and 42 of the breaker 34 are in contact with each other. The breaker 34 is thus normally closed, in order to allow the supply of current to said windings 19, 20 upon activation of the warning device.

When the warning device is activated, the excitation of the windings 19, 20 causes a mutual approach displacement of the movable members 8 and 9, which with the end edges of the respective bell-shaped portions 8*a*, 9*a* engage the bent end appendixes 44, 43, causing separation of the contact members 41 and 42. The breaker 34 is thus opened and it interrupts the flow of current to windings 19 and 20. The movable ferromagnetic members 8 and 9 are then brought back towards the rest position under the effect of the return action exerted by the resilient diaphragms 10 and 11. The displacement of the members 8 and 9 away from each other allows then the breaker 34 to be closed and a current to be supplied once again to the windings 19 and 20.

The oceration continues in this way till when the warning device is activated, namely till when it is coupled to a voltage source (not shown).

In operation, the vibration of the diaphragms 10 and 11 3causes the generation of a sound radiation which from the variable volume chamber in which there are mounted the movable members 8 and 9, reaches the acoustic output conduit 28 through the radial passage 27.

Due to the presence of two assemblies vibrating in counterphase, with the acoustic warning device described above is practicall avoided that the casing 1 may transmit reactions or vibrations to the bodywork of the motor vehicle on which the warning device is installed.

Possible arcs cenerated between the contacts 41, 42 are "blown" under the action of the air put into vibration following the oscillation of the resilient diaphragms 10 and 11.

In FIG. 4 there is illustrated a variant or further embodiment of an acoustic warning device according to the invention.

In said figure, parts and elements already described in the foregoing have been attributed once again the same reference numerals.

The variant according to FIG. 4 differs from the embodiment previously described in that within the windings 19, 20 there are no longer any fixed ferromagnetic cores, but rather respective cylindrical appendixes 8*b*, 9*b* of the movable ferromagnetic members 8 and 9.

Between said movable ferromagnetic members there can be still provided a stationary ferromagnetic member, having for example the shape of a disk as for member 12 of FIG. 2, for the circulation of the magnetic fluxes generated by the windings. However, as an alternative, such a stationary ferromagnetic member can be avoided, and in such a case the magnetic fluxes generated by the coils circulate entirely in the two movable ferromagnetic members and the air gaps defined therebetween.

Furthermore, in such a case the two excitation windings can be replaced by a single winding.

Naturally, the principles of the invention remaining the same, the forms and the embodiments and the details of construction may be varied widely with respect to those described and illustrated surely by way of non-limiting example, without thereby departing from the scope of the present invention as defined in the appended claims.

In particular, although the above described embodiments comprise two assemblies which vibrate in phase-opposition, the invention may be advantageously applied also to acoustic warning devices provided with a sole vibrating assembly, and thus with a single resilient diaphragm.

The invention is further not intended to be limited to warning devices comprising an electromechanical breaker, but can also be implemented in acoustic warning devices in which the interruption of the excitation current is controlled by means of static electronic devices.

I claim:

1. An acoustic warning device, particularly for motor vehicles, comprising a casing (1) in which at least one diaphragm (10, 11) is mounted, at least one excitation winding (19, 20) mounted in a fixed position in the casing (1), at least one movable ferromagnetic member (8, 9), connected to the diaphragm (10, 11) and subjected in operation to the magnetic field generated by said winding (19, 20); said movable ferromagnetic member (8, 9) comprising an axial end portion (8*a*, 9*a*), within which said winding (19, 20) is disposed, an output acoustic conduit (27–29), and a normally-closed breaker device (34) including two contact members (41, 42) cooperating with each other and adapted to be drawn apart following a deformation of the diaphragm (10, 11) caused by the excitation of the associated winding (19, 20), so as to interrupt the supply of current to said winding (19, 20);

characterised in that the breaker device (34) is disposed in said acoustic output conduit (27–29).

2. A warning device according to claim 1, characterised in that said axial end portion (8*a*, 9*a*) of the movable ferromagnetic member (8, 9) has an end edge which is separated by an air gap (13, 14) from the peripheral portion of a stationary ferromagnetic member (12), connected to the winding (19, 20) and mounted in a fixed position in the casing (1) adjacent to the end portion of the winding (19, 20) opposite said movable ferromagnetic member (8, 9).

3. A warning device according to claim 2, characterised in that the stationary ferromagnetic member (12) is shaped substantially like a disk, and is disposed adjacent at least one fixed ferromagnetic core (15, 16) which extends within said winding (19, 20) till near the movable ferromagnetic member (8, 9).

4. A warning device according to claim 3, characterised in that the stationary ferromagnetic member (12) is integral with said at least one fixed core (15, 16).

5. A warning device according to claim 1, characterised in that said at least one movable ferromagnetic member (8, 9) comprises a central appendix (8*b*, 9*b*) which extends within said axial end portion (8*a*, 9*a*) thereof and within the associated winding (19, 20).

6. A warning device according to claim 1, in which said breaker device (34) comprises two blades (37, 38) carrying respective contact members (41, 42) which are in contact with each other at rest; at least one blade (37, 38) being adapted to cooperate with said at least one movable ferromagnetic member (8, 9) when in operation said movable member (8, 9) is displaced following an excitation of the associated winding (19, 20) so that the contact member (41, 42) carried by one blade (37, 38) is drawn apart from the other one (42, 41) carried by the other blade (38, 37).

7. A warning device according claim 1, comprising:

a first and a second diaphragm (10, 11) which are disposed in facing relationship and at a mutual distance in the casing (1), with the respective peripheral portions clamped in the casing (1); saiddiaphragms (10, 11) being resiliently deformable and adapted to define therebetween a variable-volume chamber (7) in communication with the input (27) of an acoustic output conduit (27–29), a first and a second movable ferromagnetic member (8, 9) which are axially facing each other and separated by an air gap (13, 14) and which at opposed ends thereof are connected to the first and the second diaphragm (10, 11), respectively;

said at least one winding (19, 20) being operatively coupled to said movable ferromagnetic members (8, 9) in a way such that intermittent excitation of said winding (19, 20) causes corresponding movements in opposition of said movable members (8, 9) and the vibration in counterphase of the associated diaphragms (10, 11).

8. A warning device according to claim 6, characterised in that said blades (37, 38) extend in said chamber (7) and are adapted to cooperate each with a respective one of said movable ferromagnetic members (8, 9) so that when in operation said movable members (8, 9) move one toward the other, the contact members (41, 42) carried by said blades (37, 38) move one away from the other.

9. A warning device according to claim 8, characterised in that said blades (37, 38) are disposed in facing relationship in the direction of displacement of said movable ferromagnetic members (8, 9) and are provided each with a respective end appendix (43, 44) which is bent towards the other blade (38, 37) and has an end portion facing an engagement surface (8*a*, 9*a*) of an associated ferromagnetic movable member (8, 9).

10. A warning device according to claim 7, characterised in that said movable ferromagnetic members (8, 9) have respective bell-shaped portions (8*a*, 9*a*), one facing the other, surrounding said at least one winding (19, 20); the stationary ferromagnetic member (12) extending radially in the air gap (13, 14) defined between the bell-shaped portions (8*a*, 9*a*) of said movable ferromagnetic members (8, 9).

11. A warning device according to claim 10, characterised in that said stationary ferromagnetic member (12) is shaped substantially as a disk and is disposed between two fixed ferromagnetic cores (15, 16) having a reduced diameter, which are disposed coaxially with each other and therewith.

12. A warning device according to claim 11, characterised in that it includes two excitation windings (19, 20) disposed each around a respective fixed core (15, 16).

13. warning device according to claim 8, characterised in that said stationary ferromagnetic member (12) is provided with a peripheral radial slot (12*a*) and in that the free ends of the blades (37, 38) of the breaker device (34) extend in said slot (12*a*).

* * * * *